US008584265B2

(12) United States Patent
Lilenthal et al.

(10) Patent No.: US 8,584,265 B2
(45) Date of Patent: Nov. 19, 2013

(54) HEAD SUSPENSION SYSTEM AND HEADGEAR WITH REPLACEABLE HEADBAND BRIDGE AND METHOD OF ADJUSTING SAME

(75) Inventors: Niklas Lilenthal, Djura (SE); Jonas D. Fridholm, Ekerö (SE)

(73) Assignee: 3M Innovative Properties Company, St. Paul, MN (US)

( * ) Notice: Subject to any disclaimer, the term of this patent is extended or adjusted under 35 U.S.C. 154(b) by 1481 days.

(21) Appl. No.: 11/379,140

(22) Filed: Apr. 18, 2006

(65) Prior Publication Data

US 2007/0245466 A1 Oct. 25, 2007

(51) Int. Cl.
*A42B 1/22* (2006.01)

(52) U.S. Cl.
USPC ..... 2/417; 2/418

(58) Field of Classification Search
USPC ..... 2/410, 417, 418, 421, 422, 424
See application file for complete search history.

(56) References Cited

U.S. PATENT DOCUMENTS

| | | | | |
|---|---|---|---|---|
| 3,500,474 | A | 3/1970 | Austin | |
| 4,051,555 | A | 10/1977 | Daly | |
| 4,888,831 | A | 12/1989 | Oleson | |
| 4,942,628 | A | 7/1990 | Freund | |
| 5,044,019 | A * | 9/1991 | Shewchenko et al. | 2/421 |
| 5,077,836 | A | 1/1992 | Idoff et al. | |
| 5,269,026 | A * | 12/1993 | McManus | 2/411 |
| 5,571,217 | A | 11/1996 | Del Bon et al. | |
| 5,608,917 | A | 3/1997 | Landis et al. | |
| 5,896,586 | A | 4/1999 | Freund | |
| 5,898,949 | A | 5/1999 | Barthold et al. | |
| 6,032,297 | A * | 3/2000 | Barthold et al. | 2/416 |
| 6,081,931 | A | 7/2000 | Burns et al. | |
| 6,341,382 | B1 | 1/2002 | Ryvin et al. | |
| 6,367,085 | B1 | 4/2002 | Berg | |
| 6,481,019 | B2 * | 11/2002 | Diaz et al. | 2/171.3 |
| 6,481,023 | B2 * | 11/2002 | Wise et al. | 2/416 |
| 6,912,736 | B2 * | 7/2005 | Moeller et al. | 2/421 |
| 6,966,074 | B2 * | 11/2005 | Huh | 2/414 |
| 7,007,306 | B2 | 3/2006 | Howard et al. | |
| 2006/0107440 | A1 * | 5/2006 | Keffer | 2/175.1 |

FOREIGN PATENT DOCUMENTS

JP 2003-049316 2/2003

OTHER PUBLICATIONS

"Optrel Galaxy Welding Helmet", Western Safety Products, Inc., Seattle, Washington, USA [on line], retrieved from internet on Apr. 7, 2006, <http://www.westernsafety.com/optrelwelding/optrelweldingpg1.html>.

U.S. Appl. No. 11/379,144, filed Apr. 18, 2006 to Lilenthal et al. entitled *Head Suspension System and Headgear That Have an Adjustable Visor and Method of Adjusting Same.*

* cited by examiner

*Primary Examiner* — Shelley Self
*Assistant Examiner* — Andrew Sutton
(74) *Attorney, Agent, or Firm* — Kenneth B. Wood

(57) ABSTRACT

Headgear and head suspension system adapted to support an object with a head of a wearer. A flexible circumferential band has an anterior portion and a posterior portion, at least a portion of the anterior portion of the flexible circumferential band having a replaceable headband bridge having a particular configuration. A configuration of the head suspension system may be modified by replacing the replaceable headband bridge with another headband bridge of a different configuration.

28 Claims, 4 Drawing Sheets

HEAD SUSPENSION SYSTEM AND HEADGEAR WITH REPLACEABLE HEADBAND BRIDGE AND METHOD OF ADJUSTING SAME

The present invention relates generally to head suspension systems and headgear that have adjustments in size or configuration and to methods of adjusting or configuring head suspension systems.

BACKGROUND

Protective helmets, particularly welding helmets, tend to be heavy and cumbersome. The weight of a protective helmet can be burdensome on a wearer who may often already be working in extreme conditions of heat and other adverse elements. The weight of the protective helmet adds further to that burden.

A head suspension system for a protective helmet must be adjusted to the particular requirements of the wearer for the helmet to be comfortable. An ill fitting helmet, especially one that is heavy, may be extremely uncomfortable for a wearer, which could lead to operating mistakes and, possibly, injury.

Adjustment mechanisms on conventional protective helmets, such as welding helmets, are typically either bulky, difficult to adjust, or both. Adjustment mechanisms that require a bulky adjustment knob can add a considerable weight to the protective helmet. Common adjustment mechanisms may also involve removable and replaceable bolts or set screws that can be very difficult to adjust. Bolts that must be undone often lead to a multiplicity of loose bolts, nuts and washers that may be difficult to reassemble. This can be especially true when the wearer is wearing protective hand gear such as gloves.

Some head suspension systems may be adjusted by repositioning straps. One example of a head suspension adjustment mechanism adjusted by repositioning a headband strap is disclosed in U.S. Pat. No. 5,608,917, Landis et al, Ergonomic Head Band Apparatus. An ergonomic head band includes a strap having first and second upwardly curved side arcuate segments, a front arcuate region and tails which couple together at the back of a wearer's head. The tails are repositionable on each other providing a common sizing adjustment. Face shields or other apparatus may be coupled to the head band.

Other headgear supports provide adjustability with headbands with ends that slide relatively to each other. Examples are found in U.S. Pat. No. 3,500,474, Austin, Adjustable Headband; U.S. Pat. No. 4,888,831, Oleson, Adjustable Head Band Suspension System For Use With Hard Hat Shell, providing a slidably disposed adjusting device; U.S. Pat. No. 5,896,586, Freund, Adjustable Headband Having a Resiliently Bowable Fastener Surface, having a plurality of longitudinally spaced slots and a resilient fastener with a channel to slidably receive the end with the spaced slots; and U.S. Pat. No. 6,341,382, Ryvin et al, One-Piece Adjustable Headgear Support, having an integrally formed slidable adjustment mechanism. However, such adjustment mechanisms are not always easy for a wearer in the field to adjust and may add unnecessary weight to the protective helmet.

U.S. Pat. No. 5,077,836, Idoff et al, Headgear, discloses a headgear for mounting protective equipment such as a visor. The head band includes a brow band section, side band section and a neck band section. The neck band portion includes an adjustment mechanism including slidable portions secured with a knob. In addition, the brow section includes an adjustable buckle. Again, the adjustment mechanism can be unduly difficult for a user to adjust and may add unnecessary weight to the headgear.

U.S. Pat. No. 4,942,628, Freund, Helmet Suspension Having Ratchet Adjustment, discloses a head protection or helmet suspension having a ratchet adjustment for the adjustment of the head suspension in size. An adjustment knob engages pins in the ratchet case to lock the head suspension size in position. The adjustment knob and ratcheting mechanism may add unnecessary weight to the helmet.

U.S. Pat. No. 5,571,217, Del Bon et al, Protective Assembly For The Protection Of The Human Head, discloses a protective assembly which has a circular support structure adapted to be connected to the head of the person wearing the protective assembly. A protective visor is pivotally connected to the support structure to be swiveled for a lower operating position and to an upper resting position. A rear ratcheting adjustment mechanism provides size adjustment for the headband. The ratcheting mechanism may add unnecessary weight to the helmet.

U.S. Pat. No. 7,007,306, Howard et al, Face Shield Assembly, discloses a face shield assembly including a frame and a removable protective element supported by the frame. The frame is pivotally supported on a support structure such that the frame can be moved between an upper (out of use) and a lower (in use) position. A rear adjustment knob allows a rear head band portion to be selectively secured in a slidable position providing rear size adjustment. Again, the rear adjustment knob and slide mechanism may add unnecessary weight to the helmet.

SUMMARY

The present invention provides a head suspension system, headgear and method of adjusting that is lightweight, easily adjustable and comfortable. The protective head gear may be used by the wearer in the field in difficult conditions and yet may be easily adjusted, without tools, to fit the wearer and provide a safe and comfortable working environment.

In an embodiment, the present invention provides a head suspension system adapted to support an object with a head of a wearer. A flexible circumferential band has an anterior portion and a posterior portion, at least a portion of the anterior portion of the flexible circumferential band having a replaceable headband bridge having a particular configuration. Thus, a configuration of the head suspension system may be modified by replacing the replaceable headband bridge with another headband bridge of a different configuration.

In an embodiment, the present invention provides a head suspension system adapted to support an object with a head of a wearer. A flexible circumferential band has an anterior portion and a posterior portion, at least a portion of the anterior portion of the flexible circumferential band comprising a plurality of interchangeable headband bridges with each of the plurality of interchangeable headband bridges being of a different configuration. Thus, the head suspension system may be modified by interchanging one of the plurality of interchangeable headband bridges with another of the plurality of interchangeable headband bridges of a different configuration.

In an embodiment, the present invention provides a head suspension kit for a head suspension system adapted to support an object with a head of a wearer having a flexible circumferential band has an anterior portion and a posterior portion and a plurality of interchangeable headband bridges, each of the plurality of interchangeable headband bridges being of a different configuration. The flexible circumferential band has at least a portion of which being replaceable with one the plurality of interchangeable headband bridges. Thus, the head suspension system having a particular configuration may be determined by selecting and using one of the plurality of interchangeable headband bridges with the anterior portion of the flexible circumferential band.

In an embodiment, the headband bridges have a particular length which may be interchanged with a headband bridge of a different length in order to alter a size of the head suspension system.

In an embodiment, the particular configuration is selected from the group consisting of length, width, material, temperature characteristic and attachment point.

In an embodiment, additionally a crown band having two ends with each of the two ends is joined with the flexible circumferential band at side locations.

In an embodiment, each of the plurality of interchangeable headband bridges are releasably coupled with a remaining portion of the flexible circumferential band.

In an embodiment, each of the plurality of interchangeable headband bridges are manually releasably coupled with a remaining portion of the flexible circumferential band without use of a tool.

In an embodiment, each of the plurality of interchangeable headband bridges manually snap in and snap out of releasable coupling with a remaining portion of the flexibly circumferential band.

In an embodiment, the plurality of interchangeable headband bridges are releasably coupled with the posterior portion.

In an embodiment, the headband bridge has a plurality of cut-outs increasing flexibility and lowering weight of each of the plurality of interchangeable headband bridges.

In an embodiment, at least some of the plurality of cut-outs extend into one longitudinal edge of each of the plurality of interchangeable headband bridges.

In an embodiment, at least some of the plurality of cut-outs extend into both longitudinal edges of each of the plurality of interchangeable headband bridges.

In an embodiment, the headband bridge provides a relatively gross size adjustment mechanism and further comprising a relatively fine size adjustment mechanism associated with the posterior portion of the flexible circumferential band.

In an embodiment, the head suspension system is utilized in a headgear.

In an embodiment, the present invention provides a method of adjusting a head suspension system adapted to support an object with a head of a wearer. The head suspension system has a flexible circumferential band having an anterior portion and a posterior portion. At least a portion of the anterior portion of the flexible circumferential band has a plurality of interchangeable headband bridges with each of the plurality of interchangeable headband bridges being of a different configuration. One of the plurality of interchangeable headband bridges is selected. The selected headband bridge is attached in the circumferential band thereby modifying a configuration of the head suspension system.

In an embodiment, another one of the plurality of interchangeable headband bridges is detached before the selected headband bridge is attached.

In an embodiment, the plurality of interchangeable headband bridges provide a relatively gross size adjustment mechanism and further comprising the step of making a relatively fine size adjustment with the posterior portion of the flexible circumferential band.

DRAWINGS

DETAILED DESCRIPTION

As used in this description, the following terms have the meanings indicated:

"Headgear" means any of a number of generally protective items intended to be worn on or supported by the head of a wearer including, but not limited to, helmets and, in particular, welding helmets.

"Visor" means any of a number of devices that may be used to protect the head, face or neck of a wearer including, but not limited to, visors, face masks and face shields.

"Head suspension system" means the mechanism by which a headgear may be supported by the head of the wearer of the headgear.

"Configuration" means a particular arrangement or structure that has a particular characteristic and, as it relates to head suspension systems, a length, width, material, temperature characteristic, e.g., heating or cooling, and attachment point or points and others.

"Circumferential band" means the portion of a head suspension system that generally, at least partly, encircles the head of the wearer and supports the head suspension system against the head of the wearer, although such a circumferential band need not actually encircle the head at any particular location and it is not necessary that the circumferential band actually contact the head at a true circumference of the head.

"Anterior portion" means that portion of the head suspension system that generally is positioned toward the forward portion of the head of the wearer of the head suspension system.

"Posterior portion" means that portion of the head suspension system that generally is positioned toward the rear portion of the head of the wearer of the head suspension system.

"Side locations" mean a location or locations that are generally located toward the side of the head of the wearer when the head suspension is positioned normally on the head of the wearer.

Figure 1:
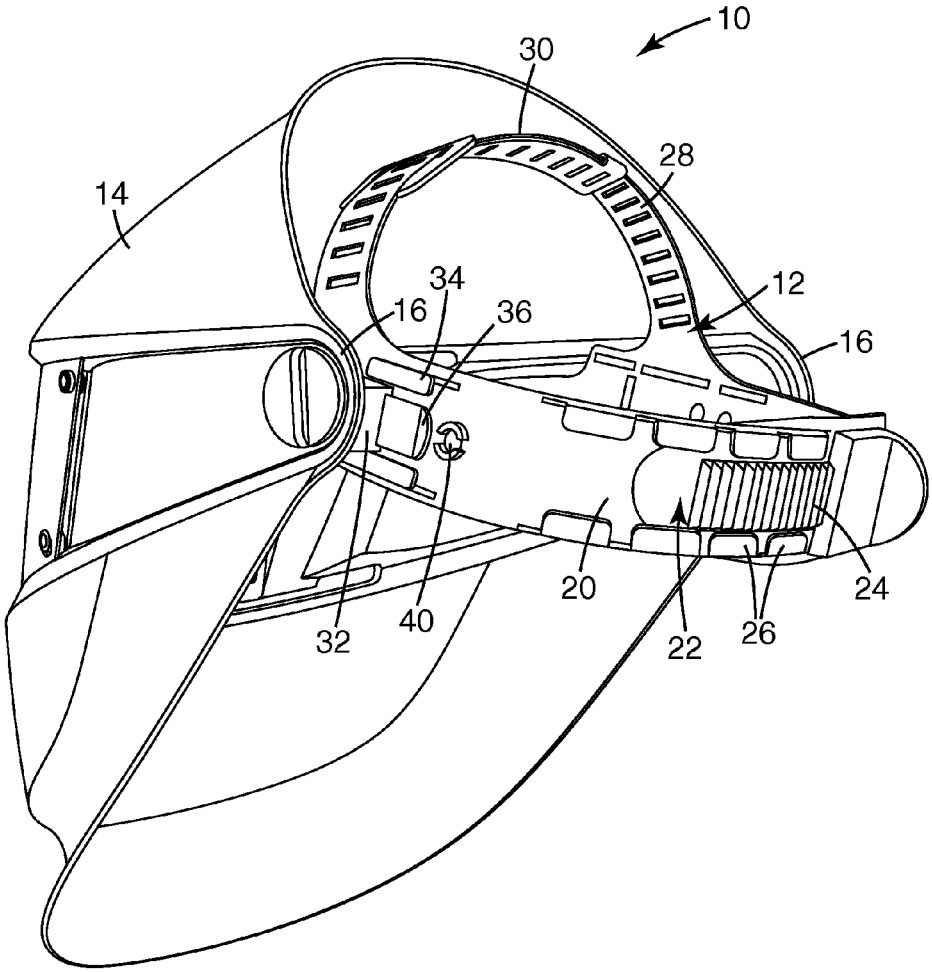
FIG. 1 shows a perspective view of a protective headgear mounted to a head suspension system.

FIG. 1 illustrates a perspective view of a headgear 10 and accompanying head suspension system 12. Visor or face shield 14 is attached to head suspension system 12 at side attachment locations 16. Different types of visors or face shields 14 may be used depending on the intended use of headgear 10. For example, a welding helmet might use a face shield 14 with a protective viewing lens, perhaps replaceable, contained in face shield 14.

Side attachment locations 16 preferably allow visor or face shield 14 to pivot between a down position with visor 14 in front of the face of the wearer in a ready-to-work position and an up position with visor 14 above the head of the wearer allowing an unencumbered view.

Head suspension system 12 consists generally of circumferential band 18 and crown band 28. Circumferential band 18 generally sits on the head of the wearer supporting visor 14 in relation to the head and face of the wearer. Posterior portion 20 of circumferential band 18 contains a fine adjustment mechanism 22 consisting of ratcheting member 24 retained in slide 26 which adjustably secures ends of separate parts of posterior portion 20 together an adjustable manner. An adjustment mechanism such as fine adjustment mechanism 22 is well known in the art.

Head suspension system 12 also contains a "gross" or large adjusting mechanism. Hence, fine adjustment mechanism 22 may be constructed to be smaller and of lighter weight since fine adjustment mechanism doesn't need to accommodate such a large change in size, i.e., length, due to the presence of a separate gross adjustment mechanism.

Head suspension system 12 also has crown band 28 attached to circumferential band 18 and intended to pass over the top of the wearer's head to provide additional support. Slide adjustment mechanism 30 allows crown band 28 to be adjusted for fit.

Slide attachment 32, in this embodiment also serving as an attachment point for visor 14, is secured in circumferential band 18 by slide channel 34. Slide attachment 32 is pivotally coupled with visor 14. Resilient tab 36, coupled with slide attachment, allows visor 14 to be adjusted fore or aft with respect to the face of the wearer while headgear 10 is being worn by the wearer. Resilient tab 36 may be grasped and lifted by the wearer or another so that projection or peg 38 may be disengaged from hole 40 contained on or in circumferential band 18. Once disengaged, resilient tab 36 may easily be maneuvered to slide the slide attachment 32 forward, moving visor 14 outward, or aft, moving visor 14 inward. Resilient tab 36 may release projection or peg 38 into another one of holes 40 securing visor 14 in another position with respect to the face of the wearer. The resilient nature of resilient tab 36 allows projection or peg 38 to be retained in hole 40 until such resilient tab 36 is again lifted and secures visor 14 in a forward/aft position. Visor 14 may still pivot on slide attachment 32.

Figure 2:
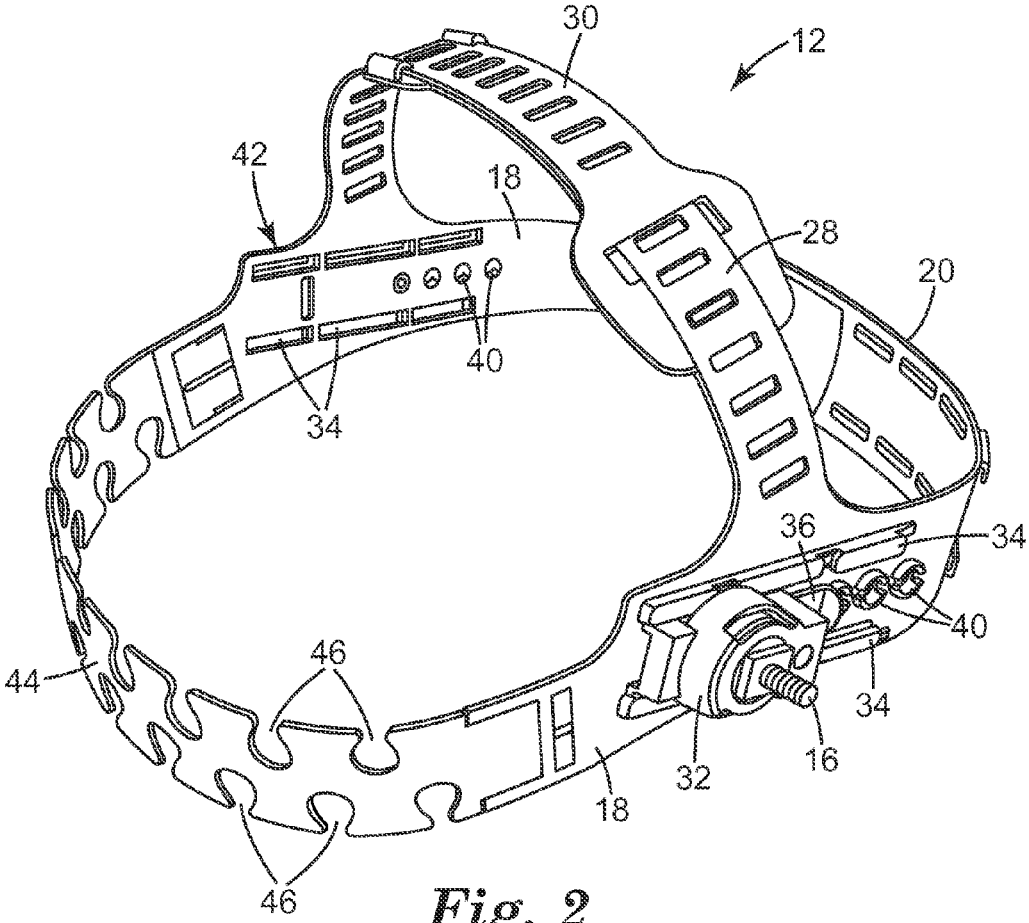
FIG. 2 shows a perspective view of the head suspension system of FIG. 1.

FIG. 2 illustrates head suspension system 12 without visor or face shield 14 installed for greater clarity. FIG. 2 provides a better illustration of anterior portion 42 of head suspension system 12 with circumferential band 18. Anterior portion 42 of circumferential band 18 is illustrated with replaceable bridge 44 or one of a plurality of interchangeable bridges 44. Bridge 44 is coupled, at both of its ends, into circumferential band 18. While shown encompassing a majority of anterior portion 42, it is to be recognized and understood that bridge 44 may encompass a smaller or larger part of anterior portion 42. It is also possible that bridge 44 may be accommodated in posterior portion 20 although superior operation and performance are expected with an anterior portion 42 location.

It is also possible that more than one bridge 44 may be used in a single circumferential band 18. If this is case, one or more of multiple bridges 44 may be used in differing combinations to obtain even a greater variability in possible length adjustments.

Cut-outs or openings 46, preferably several, many or a multiplicity, in bridge 44 provide additional flexibility of bridge 44 and, hence, circumferential band 18 of which bridge 44 is a part. Such cut-outs or openings 46 also provide additional lightness to circumferential band 18. Although shown as cut-outs 46 extending alternately from opposite sides on bridge 44, it is to be recognized and understood that such cut-outs 46 could extend from only one edge of bridge 44 or cut-outs 46 may instead be openings 46 or holes within bridge 44 not extending to either side edge of bridge 44, or both cut-outs 46 and openings 46 may be used.

Figure 3:
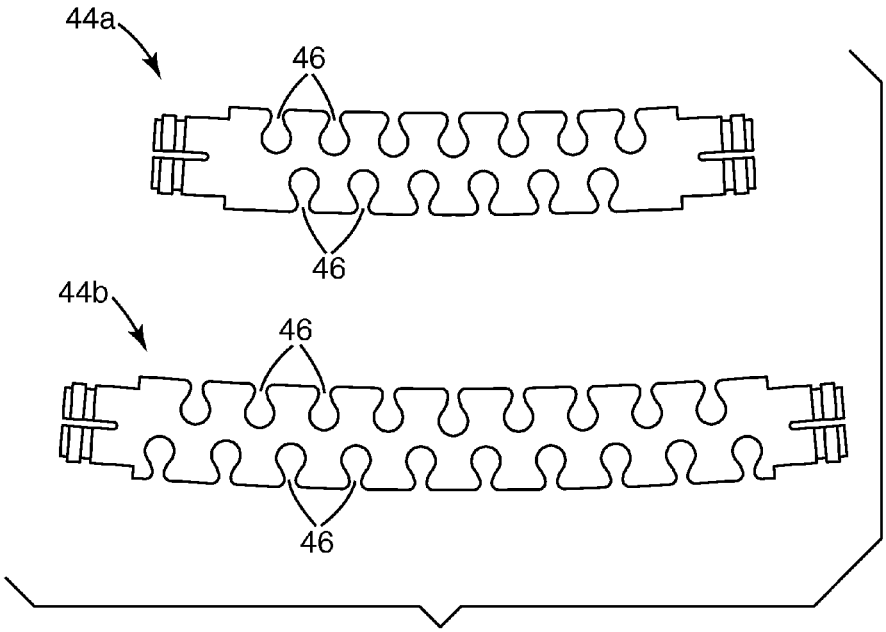
FIG. 3 illustrates two different configurations of a replaceable headband for the head suspension system of FIG. 2.

Bridge 44 may be provided in differing configurations. As shown in FIG. 3, bridge 44*a* is substantially shorter in length than bridge 44*b*. A gross size adjustment can be made to circumferential band 18 by replacing, changing or interchanging bridge 44*a* with bridge 44*b*, in this example making circumferential band 18 larger in circumference. This gross adjustment in the length of circumferential band 18 allows fine adjustment mechanism 22 to be much smaller, less complicated and, importantly, lighter and less expensive.

Figure 4:
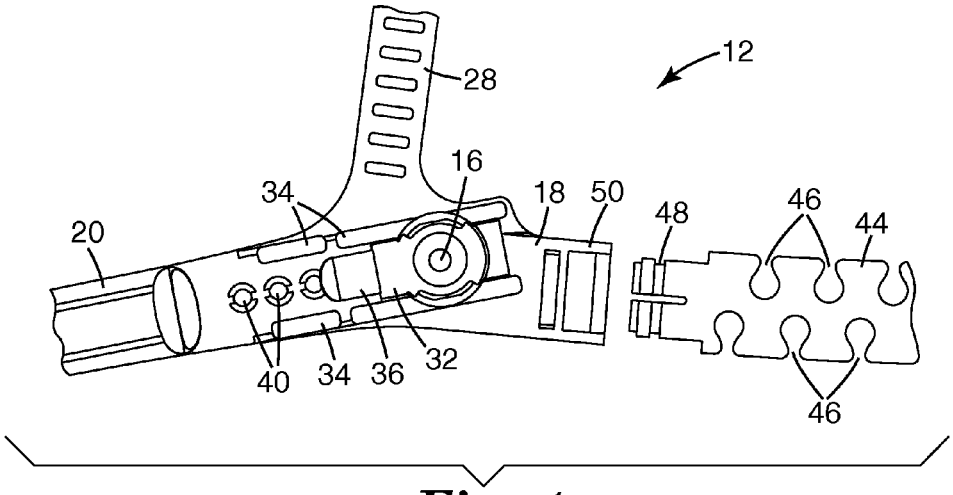
FIG. 4 illustrates a side view of a replaceable headband of FIG. 3 decoupled from the head suspension system of FIG. 2.
Figure 5:
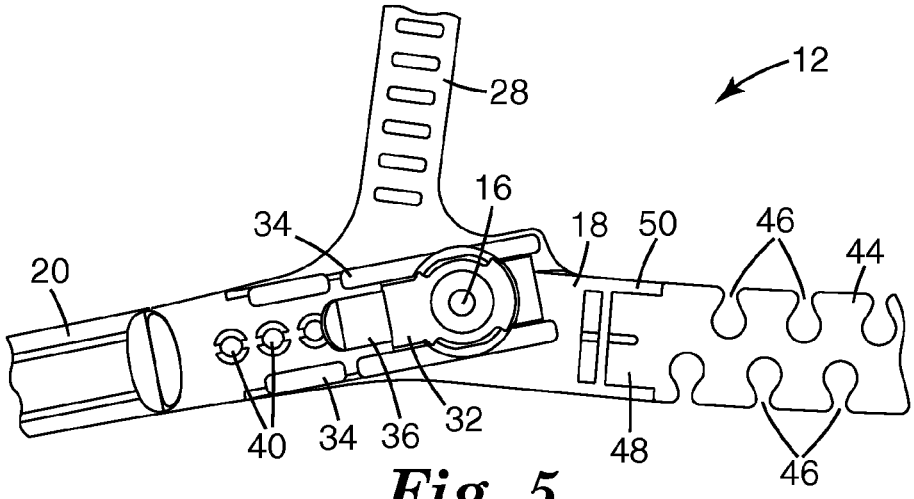
FIG. 5 illustrates a side view of a replaceable headband of FIG. 3 coupled in the head suspension system of FIG. 2.

Bridges 44, such as bridge 44*a* and bridge 44*b* in FIG. 3, may be easily replaced as shown in FIG. 4 and FIG. 5. FIG. 4 illustrates bridge 44 disengaged or decoupled from circumferential band 18. End 48 of bridge 44 may be easily interlocked with end 50 of circumferential band 18, preferably in the snap-in and snap-out arrangement illustrated. Such snap-in, snap-out connecting mechanisms are common and well known in the art as, for example, as used in belt couplings.

End 48 of bridge 44 is illustrated snapped into coupled engagement with end 50 of circumferential band 18 in FIG. 5. Such snap-in, snap-out coupling requires no tools and is very light weight and simple to use. The ends (48, 50) may be easily grasped and manipulated, even with gloves that a headgear wearer may be wearing.

While the gross adjustment mechanism for circumferential band 18 as embodied by bridge 44 or multiple bridges, for example bridge 44*a* and bridge 44*b*, may require separate interlocking parts which need to be available, it is to be recognized that usually headgear 10 may generally be worn by only a single wearer. This wearer could then select the particular bridge 44 required for that wearer's gross size adjustment and put on headgear 10. The wearer could then use fine adjustment mechanism 22 to make headgear 10 comfortable and safe to wear and be ready to work. This wearer probably doesn't have to go back and make an additional gross adjustment by replacing bridges 44 and, hence, doesn't need to keep a bridge 44 not being used on the wearer's person. The wearer can still make fine adjustments while headgear 10 is in use using fine adjustment mechanism 22. However, if a gross adjustment ever needed to be made, e.g., a different wearer or perhaps an additional protective wrap or scarf around the wearer's head, then the replacement or interchangeable bridge 44 would be available to make the necessary gross adjustment without sacrificing weight, comfort or fine adjustment capability.

Alternative to adjustment in length, or in addition to adjustment in length, multiple bridges 44 or a replaceable bridge 44 may be used to alter the other configurations of head suspension system 12. As an example, bridges 44 constructed of different materials may be used. Perhaps a bridge 44 constructed of a particular material, e.g., polyethylene for weight savings, chemical resistance and cost; nylons and polyesters for temperature tolerance and durability; and silicone or cross-linked rubber for conformability and some degree of stretch, as examples, may be better suited in certain environments or for certain work than a bridge 44 constructed on a different material, e.g., cloth or fabric. Composite materials such as laminates may also be employed, e.g., foam-plastic laminates might be used where the foam would be placed against the forehead to better conform to the shape of the head of the wearer, provide liquid absorbency, wicking or cushioning. Solid plastic materials with microstructured, fibroized or textured surface topographies that would contact the forehead could be employed to improve comfort, fit or frictional characteristics. Woven fiber structures such as webbing or fabric could also be employed in embodiments. Elasticized composites could also be used, for example where a degree of stretch is desirable for improved fit. As another example, bridges 44 of differing widths may be used. A bridge 44 of a certain width may be more comfortable for certain tasks than for other tasks. Further, specialized bridges 44 for certain temperature characteristics may be utilized. As an example, a bridge 44 having cooling properties may be used in warmer climates or environments. Conversely, a bridge 44 having heating or warming properties may be used in cooler climates or cooler environments. Still further, different bridges 44 may either incorporate different or additional attachment points or may shift or modify the location of existing attachment points. As an example, a particular bridge 44 may contain an attachment point for a lighting element. Bridges 44 may have certain mechanical functionality built into their structure, e.g., living hinges and pivot elements that would allow bridge 44 to rotate and flex independent of head suspension system 12 so as to provide improved fit and versatility of use. It is to be recognized and understood that these alternative examples of uses for replaceable bridges 44 or interchangeable bridges 44 are exemplary only and other configuration modifications are contemplated.

The replaceable or interchange bridge 44 allows head suspension system 12 with circumferential band 18 to be smaller, lightweight, more fit-versatile, comfortable, easy to adjust and inexpensive, providing significant advantages not achieved by headgear or head suspension systems shown in the art.

Thus, embodiments of the invention are disclosed. One skilled in the art will appreciate that the present invention can be practiced with embodiments other than those disclosed. The disclosed embodiments are presented for purposes of illustration and not limitation, and the present invention is limited only by the claims that follow.

What is claimed is:

1. A head suspension system adapted to support an object with a head of a wearer, comprising:

a circumferential band having an anterior portion and a posterior portion, at least a portion of said anterior portion of said circumferential band comprising a replaceable headband bridge being coupled into said circumferential band and having a plurality of cut-outs extending into both longitudinal edges of said replaceable headband bridge;

wherein the head suspension system further comprises a crown band having two ends with each of said two ends joined with said circumferential band at side locations of said circumferential band, and wherein said replaceable headband bridge is releasably coupled with a remaining portion of said circumferential band, which remaining portion of said circumferential band is not a portion of said crown band.

2. The head suspension system as in claim 1 wherein said replaceable headband bridge has a particular length which may be replaced with a headband bridge of a different length in order to alter a size of said head suspension system.

3. The head suspension system as in claim 1 wherein said replaceable headband bridge has a particular configuration that is selected from the group consisting of length, width, material, temperature characteristic and attachment point.

4. The head suspension system as in claim 1 wherein said replaceable headband bridge is manually releasably coupled with a remaining portion of said circumferential band without use of a tool.

5. The head suspension system as in claim 1 wherein said replaceable headband bridge manually snaps in and snaps out of releasable coupling with first and second ends of a remaining portion of said circumferential band, which first and second ends of said remaining portion of said circumferential band are not ends of said crown band.

6. The head suspension system as in claim 1 wherein said replaceable headband bridge provides a size adjustment mechanism by replacement with another headband bridge having a different length and wherein the head suspension system further comprises an additional size adjustment mechanism associated with said posterior portion of said circumferential band.

7. A headgear adapted to protect a wearer, comprising:

a visor; and a head suspension system as in claim 1.

8. A head suspension system adapted to support an object with a head of a wearer, comprising:

a circumferential band having an anterior portion and a posterior portion, at least a portion of said anterior portion of said circumferential band comprising an interchangeable headband bridge that is coupled into said circumferential band and that is chosen from a plurality of interchangeable headband bridges, with each interchangeable headband bridge of said plurality of interchangeable headband bridges being of a different particular configuration;

whereby said head suspension system may be modified by interchanging one interchangeable headband bridge of said plurality of interchangeable headband bridges with another interchangeable headband bridge of said plurality of interchangeable headband bridges, of a different particular configuration;

wherein the head suspension system further comprises a crown band having two ends with each of said two ends joined with said circumferential band at side locations of said circumferential band, and wherein each interchangeable headband bridge of said plurality of interchangeable headband bridges is releasably couplable with a remaining portion of said circumferential band, which remaining portion of said circumferential band is not a portion of said crown band.

9. The head suspension system as in claim 8 wherein each interchangeable headband bridge of said plurality of interchangeable headband bridges has a particular length and may be interchanged with a headband bridge of a different length in order to alter a size of said head suspension system.

10. The head suspension system as in claim 8 wherein said particular configuration is selected from the group consisting of length, width, material, temperature characteristic and attachment point.

11. The head suspension system as in claim 8 wherein each interchangeable headband bridge of said plurality of interchangeable headband bridges is manually releasably couplable with a remaining portion of said circumferential band without use of a tool.

12. The head suspension system as in claim 8 wherein each interchangeable headband bridge of said plurality of interchangeable headband bridges manually snaps in and snaps out of releasable coupling with first and second ends of a remaining portion of said circumferential band, which first and second ends of said remaining portion of said circumferential band are not ends of said crown band.

13. The head suspension system as in claim 11 wherein each interchangeable headband bridge comprises a first end that manually snaps into releasable coupling with a first, anterior end of said remaining portion of said circumferential band by way of said first end of said headband bridge being moved posteriorly toward said first, anterior end of said remaining portion of said circumferential band until said first end of said headband bridge end interlocks with said first, anterior end of said remaining portion of said circumferential band.

14. The head suspension system as in claim 8 wherein each interchangeable headband bridge of said plurality of interchangeable headband bridges has a plurality of cut-outs increasing flexibility and lowering weight of each interchangeable headband bridge of said plurality of interchangeable headband bridges.

15. The head suspension system as in claim 14 wherein at least some of said plurality of cut-outs extend into one longitudinal edge of each interchangeable headband bridge of said plurality of interchangeable headband bridges.

16. The head suspension system as in claim 15 wherein at least some of said plurality of cut-outs extend into both longitudinal edges of each interchangeable headband bridge of said plurality of interchangeable headband bridges.

17. The head suspension system as in claim 8 wherein said plurality of interchangeable headband bridges provide a size adjustment mechanism and wherein the head suspension system further comprises an additional size adjustment mechanism associated with said posterior portion of said circumferential band.

18. A headgear adapted to protect a wearer, comprising:

a visor; and a head suspension system as in claim 8.

19. A head suspension kit for a head suspension system adapted to support an object with a head of a wearer, comprising:

a circumferential band having an anterior portion and a posterior portion; and a plurality of interchangeable headband bridges, each interchangeable headband bridge of said plurality of interchangeable headband bridges being of a different configuration;

said circumferential band having at least a portion that is replaceable with any interchangeable headband bridge of said plurality of interchangeable headband bridges, wherein each interchangeable headband bridge can be coupled into the circumferential band;

whereby said head suspension system having a particular configuration may be determined by selecting one interchangeable headband bridge of said plurality of interchangeable headband bridges and inserting the one interchangeable headband bridge in place of the replaceable portion of said circumferential band;

wherein the head suspension system further comprises a crown band having two ends with each of said two ends joined with said circumferential band at side locations of said circumferential band, and wherein each interchangeable headband bridge of said plurality of interchangeable headband bridges is releasably couplable with a remaining portion of said circumferential band, which remaining portion of said circumferential band is not a portion of said crown band.

20. The head suspension kit as in claim 19 wherein each interchangeable headband bridge of said plurality of interchangeable headband bridges has a particular length and may be interchanged with a headband bridge of a different length in order to alter a size of said head suspension system.

21. The head suspension kit as in claim 19 wherein said configuration of each interchangeable headband bridge of said plurality of interchangeable headband bridges is selected from the group consisting of length, width, material, temperature characteristic and attachment point.

22. The head suspension kit as in claim 19 wherein each interchangeable headband bridge of said plurality of interchangeable headband bridges is manually releasably couplable with a remaining portion of said circumferential band without use of a tool.

23. The head suspension kit as in claim 22 wherein each interchangeable headband bridge of said plurality of interchangeable headband bridges manually snaps in and snaps out of releasable coupling with first and second ends of a remaining portion of said circumferential band, which first and second ends of said remaining portion of said circumferential band are not ends of said crown band.

24. The head suspension kit as in claim 22 wherein each interchangeable headband bridge comprises a first end that manually snaps into releasable coupling with a first, anterior end of said remaining portion of said circumferential band by way of said first end of said headband bridge being moved posteriorly toward said first, anterior end of said remaining portion of said circumferential band until said first end of said headband bridge end interlocks with said first, anterior end of said remaining portion of said circumferential band.

25. The head suspension kit as in claim 19 wherein each interchangeable headband bridge of said plurality of interchangeable headband bridges has a plurality of cut-outs increasing flexibility and lowering weight of each interchangeable headband bridge of said plurality of interchangeable headband bridges.

26. The head suspension kit as in claim 25 wherein at least some of said plurality of cut-outs extend into one longitudinal edge of each interchangeable headband bridge of said plurality of interchangeable headband bridges.

27. The head suspension kit as in claim 26 wherein at least some of said plurality of cut-outs extend into both longitudinal edges of each interchangeable headband bridge of said plurality of interchangeable headband bridges.

28. The head suspension kit as in claim 19 wherein said plurality of interchangeable headband bridges provide a size adjustment mechanism and wherein the head suspension system further comprises an additional size adjustment mechanism associated with said posterior portion of said circumferential band.

* * * * *